US011377815B2

(12) United States Patent
Yamashita

(10) Patent No.: US 11,377,815 B2
(45) Date of Patent: Jul. 5, 2022

(54) CONSTRUCTION MACHINE

(71) Applicant: KOBELCO CONSTRUCTION MACHINERY CO., LTD., Hiroshima (JP)

(72) Inventor: Koji Yamashita, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 124 days.

(21) Appl. No.: 16/980,754

(22) PCT Filed: Feb. 6, 2019

(86) PCT No.: PCT/JP2019/004150
§ 371 (c)(1),
(2) Date: Sep. 14, 2020

(87) PCT Pub. No.: WO2019/187659
PCT Pub. Date: Oct. 3, 2019

(65) Prior Publication Data

US 2021/0002853 A1 Jan. 7, 2021

(30) Foreign Application Priority Data

Mar. 28, 2018 (JP) ..... JP2018-061968

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 3/40* (2013.01); *E02F 9/2203* (2013.01)

(58) Field of Classification Search
CPC ..... E02F 3/3681
See application file for complete search history.

(56) References Cited

U.S. PATENT DOCUMENTS 4,662,684 A * 5/1987 Marten ..... E02D 17/13 299/1.5
4,679,337 A 7/1987 Caternock et al.
(Continued)

FOREIGN PATENT DOCUMENTS

CN 201846574 U 6/2011
CN 103615025 A 3/2014
(Continued)

OTHER PUBLICATIONS

International Search Report dated Mar. 19, 2019 in PCT/JP2019/004150 filed Feb. 6, 2019, 2 pages.
(Continued)

*Primary Examiner* — Gerald McClain
(74) *Attorney, Agent, or Firm* — Oblon, McClelland, Maier & Neustadt, L.L.P.

(57) ABSTRACT

A construction machine capable of reducing a resistance that a bucket receives from the ground and improving smoothness of a construction surface includes a working device including a working device body and a bucket, first and second bucket actuators that rotationally move the bucket, and a control device. The control device controls the second bucket actuator to make the second bucket actuator periodically oscillate the bucket in a direction of a yaw motion during excavation work or ground leveling work.

8 Claims, 10 Drawing Sheets

(51) Int. Cl.
*E02F 3/40* (2006.01)
*E02F 9/22* (2006.01)

(56) References Cited

U.S. PATENT DOCUMENTS

| | | | | | |
|---|---|---|---|---|---|
| 5,398,430 | A * | 3/1995 | Scott | E02F 3/967 | 37/189 |
| 5,515,626 | A * | 5/1996 | Holscher | E02F 3/3622 | 37/468 |
| 9,816,249 | B2 * | 11/2017 | Padilla | E02F 9/265 | |
| 9,856,628 | B2 * | 1/2018 | Kitajima | E02F 3/435 | |
| 9,976,279 | B2 * | 5/2018 | Padilla | E02F 3/30 | |
| 9,976,285 | B2 * | 5/2018 | Padilla | G01S 19/13 | |
| 2001/0027366 | A1 | 10/2001 | Ikari | | |
| 2006/0129296 | A1 | 6/2006 | Ikari | | |
| 2006/0179690 | A1 | 8/2006 | Ikari | | |
| 2006/0184302 | A1 | 8/2006 | Ikari | | |
| 2008/0086920 | A1 * | 4/2008 | Lim | E02F 3/404 | 37/406 |
| 2009/0158625 | A1 * | 6/2009 | Pope | E02F 3/435 | 700/213 |
| 2013/0101341 | A1 * | 4/2013 | McDonald | F16H 1/28 | 403/62 |
| 2016/0145832 | A1 | 5/2016 | Stockhaus et al. | | |
| 2016/0237654 | A1 | 8/2016 | Arimatsu et al. | | |
| 2016/0312434 | A1 | 10/2016 | Shintani et al. | | |
| 2017/0218594 | A1 * | 8/2017 | Padilla | E02F 3/435 | |

FOREIGN PATENT DOCUMENTS

| | | | | | |
|---|---|---|---|---|---|
| CN | 105358771 | A | | 2/2016 | |
| CN | 105926695 | A | * | 9/2016 | E02F 3/3681 |
| CN | 105926695 | A | | 9/2016 | |
| CN | 105960492 | | | 9/2016 | |
| JP | 2-24424 | A | | 1/1990 | |
| JP | 6-4157 | U | | 1/1994 | |
| JP | 3019505 | U | | 10/1995 | |
| JP | 8-60692 | A | | 3/1996 | |
| JP | 08060692 | A | * | 3/1996 | |
| JP | 8-165678 | A | | 6/1996 | |
| WO | WO 2014/209209 | A1 | | 12/2014 | |
| WO | WO 2016/125232 | A1 | | 8/2016 | |

OTHER PUBLICATIONS

Combined Chinese Office Action and Search Report dated Sep. 27, 2021 in Chinese Patent Application No. 201980017376.4 (with Summary English translation), 8 pages.
Extended European Search Report dated May 31, 2021 in European Patent Application No. 19774444.4, 6 pages.

* cited by examiner

CONSTRUCTION MACHINE

TECHNICAL FIELD

The present invention relates to a construction machine such as a hydraulic excavator.

BACKGROUND ART

As shown in, for example, Patent Documents 1 and 2, there is known a technique as to a construction machine including a boom, an arm and a bucket, in which a hydraulic cylinder selected from a boom cylinder, an arm cylinder and a bucket cylinder is operated so as to oscillate the bucket during excavation work to thereby reduce an excavation resistance (a resistance that the bucket entering the ground receives from the ground).

However, each of the boom cylinder, the arm cylinder, and the bucket cylinder as described above is generally a hydraulic cylinder having a relatively large capacity, which makes it difficult to oscillate the bucket quickly (that is, in a short cycle).

Besides, since the boom cylinder, the arm cylinder, and the bucket cylinder normally move the boom, the arm, and the bucket rotationally in the pitch direction, respectively, the oscillation of the bucket made by the operation control of the hydraulic cylinders is a rotational oscillation in the pitch direction, which is likely to cause undulations and irregularities in the construction surface formed by excavation work.

In addition, for example, during ground leveling work for smoothing the ground, oscillating the bucket by operation control of any of a boom cylinder, an arm cylinder and a bucket cylinder to reduce movement resistance of the bucket makes it difficult to smooth the ground well.

CITATION LIST

Patent Literature

Patent Literature 1: JP H08-165678 A
Patent Literature 2: JP H02-024424 A

SUMMARY OF INVENTION

An object of the present invention is to provide a construction machine capable of reducing a resistance that a bucket receives from the ground and improving smoothness of a construction surface.

Provided is a construction machine comprising a machine body, a working device mounted on the machine body, and a control device for controlling a motion of the working device, wherein: the working device includes a working device body having a proximal end portion connected to the machine body and a distal end opposite thereto, a bucket attached to the distal end of the working device body so as to be capable of performing a first rotational motion and a second rotational motion relative to the distal end of the working device body, and a plurality of bucket actuators that actuate the bucket relatively to the working device body; the first rotational motion is a pitch motion that is a rotational motion about a bucket lateral axis parallel to a width direction of the bucket; the second rotational motion is a rotational motion about an axis in a direction orthogonal to the bucket lateral axis; the plurality of bucket actuators include a first bucket actuator that makes the bucket perform the first rotational motion and a second bucket actuator that makes the bucket perform the second rotational motion; and the control device is configured to control the second bucket actuator so as to make the second bucket actuator periodically oscillate the bucket based on the second rotational motion in a state where the bucket is in pressure contact with the ground.

DESCRIPTION OF EMBODIMENTS

Figure 1:
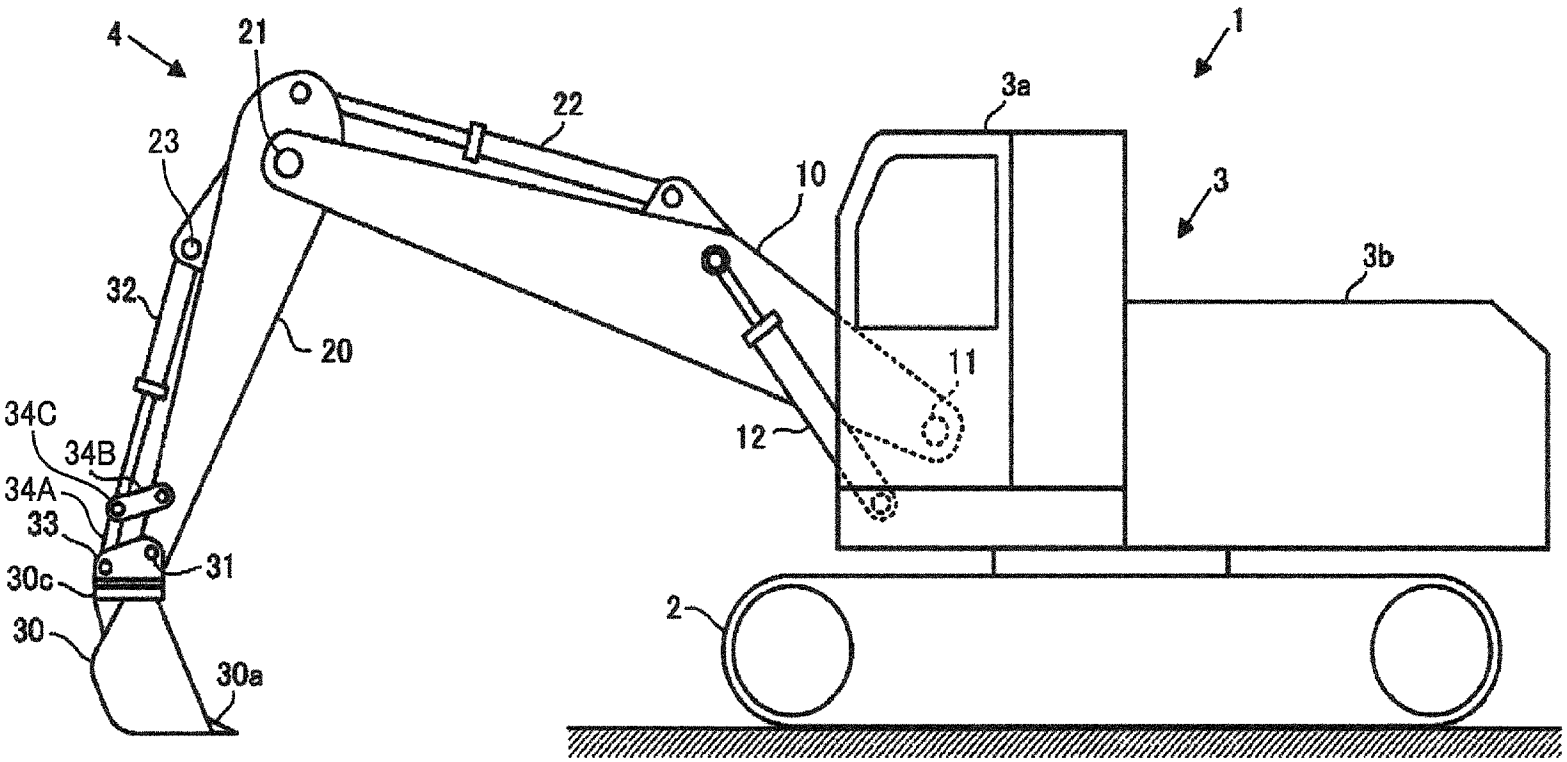
FIG. 1 is a side view showing the entire hydraulic excavator which is a construction machine according to a first embodiment of the present invention.

A first embodiment of the present invention will be described below with reference to FIGS. 1 to 6. FIG. 1 shows a construction machine 1 according to the embodiment. The construction machine 1 is, for example, a hydraulic excavator. The construction machine 1 includes a crawler-type travelling body 2, a slewing body 3 as a machine body mounted on the travelling body 2 so as to be capable of slewing, and a working device 4 attached to the slewing body 3. The travelling motion of the travelling body 2 and the slewing motion of the slewing body 3 are generated by a not-graphically-shown hydraulic motor.

The slewing body 3 includes a cab 3*a* located in the front portion of the slewing body 3 and a machine room 3*b* located in the rear portion. The machine room 3*b* houses a not-graphically-shown engine and various hydraulic devices (a hydraulic pump, a direction selector valve, etc.).

The working device 4 includes a boom 10, an arm 20, a bucket 30, and a plurality of hydraulic cylinders. In this embodiment, the boom 10 and the arm 20 constitute a working device body. The boom 10 has a proximal end portion and a distal end portion opposite thereto. The proximal end portion corresponds to the proximal end portion of the working device body, being connected to the slewing body 3 in a posture where the boom 10 extends from an appropriate position of the slewing body 3, for example, a position sideward of the cab 3*a*. The arm 20 has a proximal end portion connected to the distal end portion of the boom 10 in such a posture that the arm 20 extends beyond the distal end portion of the boom 10 and a distal end portion opposite thereto. The bucket 30 is attached to the distal end of the arm 20 as the distal end of the working device body.

The plurality of hydraulic cylinders include a boom cylinder 12, an arm cylinder 22, and a bucket cylinder 32.

The boom 10 is pivotally supported by the slewing body 3 through a support shaft 11 so as to be capable of performing a pitch motion relative to the slewing body 3. In this embodiment, the pitch motion is a rotational motion around the axis lateral of the slewing body 3. The boom 10 is connected to the slewing body 3 through the boom cylinder 12 which is a hydraulic cylinder for the boom. The boom cylinder 12 expands and contracts so as to make the boom 10 perform a rotational motion around the axis of the support shaft 11, namely, the pitch motion.

The arm 20 is attached to the distal end of the boom 10 through a support shaft 21 so as to be capable of performing the pitch motion, that is, a rotational motion around the axis lateral of the stewing body 3, relative to the boom 10. The arm 20 is connected to the boom 10 via the arm cylinder 22 which is a hydraulic cylinder for the arm. The arm cylinder 22 expands and contracts so as to make the arm 20 perform the pitch motion around the axis of the support shaft 21.

The bucket 30 is attached to the distal end portion of the arm 20, which portion corresponds to the distal end portion of the working device body, so as to be capable of performing both of a first rotational motion relative to the arm 20 and a second rotational motion. The first rotational motion is a pitch motion, that is, the rotational motion about a bucket lateral axis parallel to the width direction of the bucket 30. The second rotational motion is a rotational motion about an axis orthogonal to the bucket lateral axis, namely, a yaw motion in the first embodiment as described later in detail.

Figure 2:
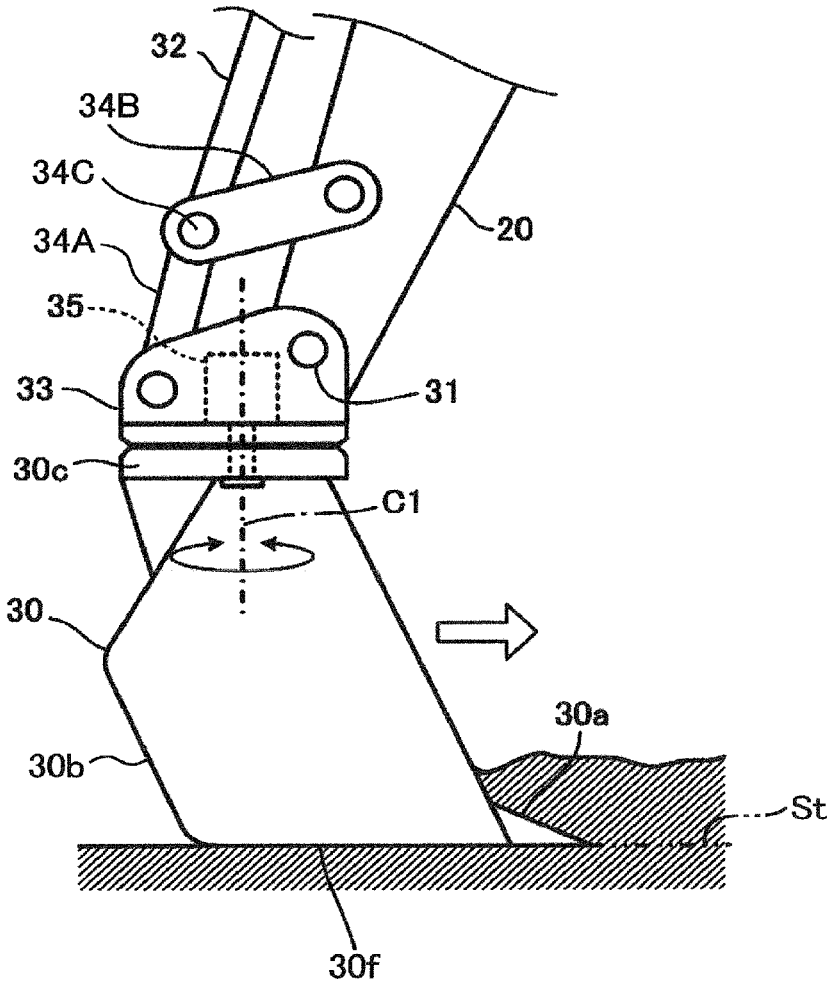
FIG. 2 is a side view showing a main part including a bucket according to the first embodiment.

As shown in FIG. 2, the bucket 30 includes a plurality of claw portions 30*a* that constitute a tip portion of the bucket 30, a bottom portion 30*b*, and a bucket-side attachment member 30*c*. The plurality of claw portions 30*a* project in the same direction from the distal edge portion of the open end of the bucket 30, that is, the distal end portion of a bucket body of the bucket 30, the bucket body serving as a portion to accommodate soil. The bucket-side attachment member 30*c* forms a proximal end portion of the bucket 30, that is, an end portion opposite to the plurality of claw portions 30*a*, being attached to the arm 20 through an arm-side attachment member 33.

The arm-side attachment member 33 is pivotally supported by the distal end of the arm 20 through a support shaft 31 so as to be capable of performing the first rotational motion, namely, the pitch motion, relative to the arm 20, and connected to the arm 20 through the first link arm 34A and the second link arm 34B. The first and second link arms 34A, 34B have respective one ends that are connected to each other through a pin 34C so as to be capable of relative and rotational movement and the other ends opposite to the one ends. The other end of the first link arm 34A is pivotally supported by the arm-side attachment member 33, and the other end of the second link arm 34B is pivotally supported by the arm 20.

The bucket cylinder 32 is a hydraulic cylinder for bucket, corresponding to the first bucket actuator according to the present invention, that is, an actuator that makes the bucket 30 perform the pitch motion relative to the arm 20. Specifically, the bucket cylinder 32 has a head-side end (an upper end in FIG. 1) and a rod-side end (a lower end in FIG. 1) opposite thereto. The head-side end portion is connected to the arm 20 through a pin 23 so as to be capable of rotational movement, and the rod-side end portion is connected to the one end portions of the first and second link arms 34A, 34B through the pin 34C so as to be capable of rotational movement. The bucket cylinder 32 expands and contracts so as to make the arm-side attachment member 33 and the bucket 30 connected to the arm-side attachment member 33 perform the pitch motion around the axis of the support shaft 31.

The bucket-side attachment member 30*c* is supported by the arm-side attachment member 33 so as to be capable of performing the second rotational motion relative to the arm-side attachment member 33 and the arm 20, namely, a yaw motion in this embodiment, specifically, the rotational motion about the yaw axis C1 shown in FIG. 2. The yaw axis C1 extends in a direction orthogonal to a ground contact wall surface 30*f* which is a wall surface from the bottom portion 30*b* of the bucket 30 to the plurality of claw portions 30*a* at the distal end (including a direction substantially orthogonal to the ground contact wall surface 30*f*), that is, an axis extending in a direction parallel to the normal direction of the ground contact wall surface 30*f* (including a direction substantially parallel to the normal direction), being an axis extending in a direction orthogonal to the axis of the support shaft 31, which is the axis of the first rotational motion of the arm-side attachment member 33, namely, the bucket lateral axis (including a direction substantially orthogonal to the bucket lateral axis).

The working device 4 further includes a bucket rotating motor 35 formed of a hydraulic motor. The bucket rotating motor 35 corresponds to a second bucket actuator that makes the bucket 30 perform the second rotational motion, namely, the yaw motion. The bucket rotating motor 35 includes a motor main body fixed to the arm-side attachment member 33 and an output shaft connected to the bucket-side attachment member 30*c*. The motor main body operates to rotate the output shaft to thereby make the bucket 30 including the bucket-side attachment member 30*c* perform the yaw motion relative to the arm-side attachment member 33 and the arm 20 connected thereto, the yaw motion being the second rotational motion, that is, a rotational motion around the yaw axis C1.

The yaw actuator (the second bucket actuator referred to in the present invention) that makes the bucket 30 perform the second rotational motion, namely, the yaw motion, relative to the arm 20 is not limited to the bucket rotating motor 35. The yaw actuator may be, for example, a hydraulic cylinder that moves the bucket-side attachment member 30*c* rotationally around the yaw axis C1 through a linear/rotational motion conversion mechanism such as a crank arm. Alternatively, the yaw actuator may be, for example, an electric motor.

Figure 3:
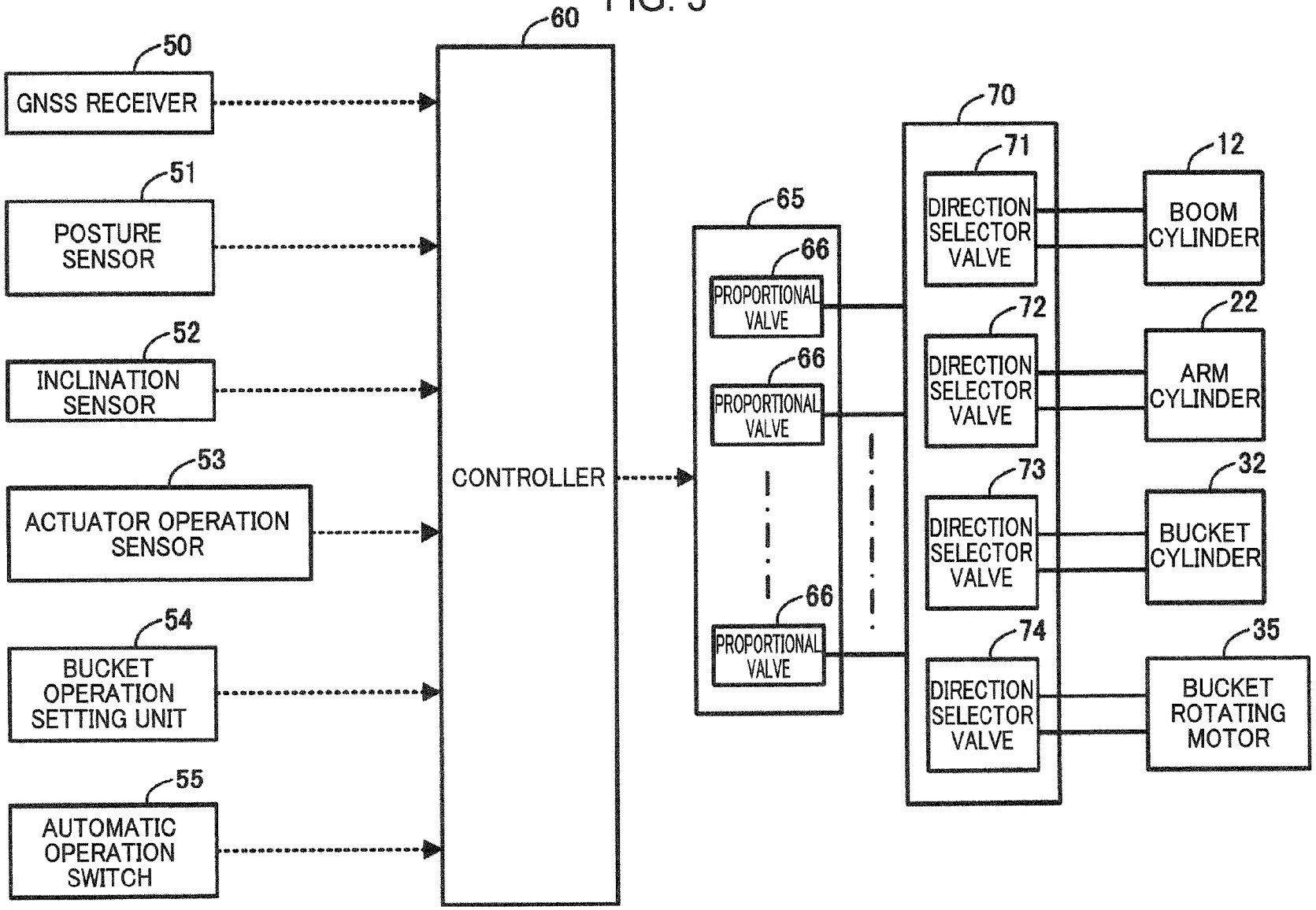
FIG. 3 is a block diagram showing a functional configuration of a control device of the construction machine according to the first embodiment.

The construction machine 1 includes a controller 60, a proportional valve group 65, and a control valve unit 70 as shown in FIG. 3. These function as a control device that controls the operation of the working device 4, specifically making it possible to carry out an automatic operation of the bucket 30 for excavation work of excavating the ground or ground leveling work of leveling the ground.

The control valve unit 70 includes direction selector valves 71, 72, 73, 74, which are provided in hydraulic oil supply passages for respective actuators of the boom cylinder 12, the arm cylinder 22, the bucket cylinder 32, and the bucket rotating motor 35, respectively, and opened and closed so as to control the supply of hydraulic oil from a not-graphically-shown hydraulic pump to the actuator. Each of the direction selector valves 71 to 74 is a pilot operated hydraulic selector valve having a pair of pilot ports, being configured to be opened, by a pilot pressure that is input to one of the pair of pilot ports, in the direction corresponding to the pilot port to which the pilot pressure is input and at the opening degree corresponding to the magnitude of the pilot pressure.

The proportional valve group 65 includes a plurality of proportional valves 66 that correspond to the direction selector valves 71, 72, 73, 74, respectively. Each of the plurality of proportional valves 66 is formed of an electromagnetic valve, being interposed between the corresponding direction selector valve of the direction selector valves 71 to 74 and a not-graphically-shown pilot hydraulic pressure source, and configured to be opened at the opening degree corresponding to a command signal input from the controller 60 to thereby change the magnitude of the pilot pressure to be input to the direction selector valve.

The controller 60 inputs an appropriate command signal to each of the plurality of proportional valves 66 to operate the direction selector valves 71 to 74 through the plurality of proportional valves 66, respectively, thereby controlling respective operations of the boom cylinder 12, the arm cylinder 22, the bucket cylinder 32, and the bucket rotating motor 35.

Since each of the direction selector valves 71, 72, 73, 74 has the pair of pilot ports, the plurality of proportional valves 66 are provided for respective pairs of pilot ports of the direction selector valves 71, 72, 73, 74. In addition to the direction selector valves 71 to 74, the control valve unit 70 may include a direction selector valve connected to a hydraulic motor that makes the travelling body 2 perform a travelling motion or a direction selector valve connected to a hydraulic motor that makes the slewing body 3 perform a slewing motion. Similarly, in addition to the plurality of proportional valves 66, the proportional valve group 65 may include a proportional valve for controlling the pilot pressure of the direction selector valve connected to each of the above hydraulic motors.

The construction machine 1 further includes: a GNSS receiver 50 (GNNS: Global Navigation Satellite System) for detecting the existence position of the construction machine 1; a plurality of posture sensors 51 for detecting the posture state of the working device 4; an inclination sensor 52 for detecting the inclination angle of the stewing body 3 (machine body); a plurality of actuator operation sensors 53 for detecting respective states of the operations for a plurality of hydraulic actuators including the boom cylinder 12, the arm cylinder 22, the bucket cylinder 32, and the bucket rotating motor 35; a bucket motion setting operation unit 54 to which a setting operation related to the second rotational motion (yaw motion) of the bucket 30 is applied; and an automatic operation switch 55 for setting the necessity of automatic operation of the bucket 30 for excavation work or ground leveling work (for switching ON/OFF of the automatic operation).

The plurality of posture sensors 51 includes a plurality of angle sensors: for example, an angle sensor that detects a pitch angle that is a rotation angle of the boom 10 relative to the slewing body 3 in the direction of the pitching motion (the direction of the rotation around the axis of the support shaft 11), an angle sensor that detects a pitch angle that is a rotation angle of the arm 20 relative to the boom 10 in the direction of the pitch motion (the direction of the rotation around the axis of the support shaft 21), an angle sensor that detects the pitch angle θp of the bucket 30 to the arm 20, that is, the rotation angle of the bucket 30 in the pitch direction, which is the direction of pitch motion of the bucket 30 (the direction of rotation around the axis of the support shaft 31), and an angle sensor that detects the yaw angle θy of the bucket 30 to the arm 20, that is, the rotation angle of the bucket 30 in a yaw direction, which is the direction of the yaw motion of the bucket 30 (the direction of the first rotation motion around the yaw axis C1). Each of the plurality of angle sensors can be formed of, for example, a rotary encoder, a resolver, or the like.

The plurality of posture sensors 51 are not limited to the plurality of angle sensors that detect respective pitch angles of the boom 10, the arm 20, and the bucket 30. The plurality of posture sensors 51 may include, for example, a plurality of stroke sensors that detect respective stroke displacements of the boom cylinder 12, the arm cylinder 22, and the bucket cylinder 32, respectively.

The inclination sensor 52 includes, for example, an inertial sensor having respective functions of an acceleration sensor and an angular velocity sensor. Based on the detection signal of the inertial sensor can be specified the inclination angle of the slewing body 3 through a strapdown method or the like.

The plurality of actuator operation sensors 53 include, for example, a plurality of pilot pressure sensors. The plurality of pilot pressure sensors are formed of respective pressure sensors that detect respective pilot pressures applied to the pair of pilot ports of the direction selector valves 71, 72, 73, 74.

The bucket motion setting operation unit 54 and the automatic operation switch 55 are disposed in the cab 3*a*. In the present embodiment, the bucket motion setting operation unit 54 is configured to allow a plurality of setting operations to be applied to the operation unit 54 during excavation work or ground leveling work. The plurality of setting operations are with respect to, for example, the necessity of a yaw oscillation that is the oscillation of the bucket 30 in the yaw direction (the periodically rotational motion of cyclically by a predetermined angle alternately in the forward rotational direction and the reverse rotational direction around the yaw axis C1, namely, the oscillation based on the second rotational motion), the cycle Ty (or frequency) of the yaw oscillation, and the amplitude Ay of the yaw oscillation (maximum rotation angle in the forward rotation direction and the reverse rotation direction). The cycle Ty (or frequency) of the yaw oscillation and the amplitude Ay of the yaw oscillation can be set within respective predetermined ranges.

The bucket motion setting operation unit 54 may receive not only an operation for setting the operation of the bucket 30 but also various other setting operations for the construction machine 1. Besides, the bucket motion setting operation unit 54 and the automatic operation switch 55 may be configured to be integral with each other.

The controller 60 is formed of an electronic circuit unit including a microcomputer, a memory, an interface circuit and the like. To the controller 60 are input a GNSS signal (a detection signal as to the existence position of the construction machine 1) received by the GNSS receiver 50, respective detection signals generated by the posture sensor 51, the inclination sensor 52, and the actuator operation sensors 53, and respective operation signals generated by the bucket motion setting operation unit 54 and the automatic operation switch 55.

In the controller 60, three-dimensional map data is stored in advance or downloaded from an external server or the like. The map data includes information about the actual topography of the work site where the work by the construction machine 1 is performed, and information about the target topography to be achieved by the work.

The controller 60 has a function of generating an appropriate command signal for each of the plurality of proportional valves 66 and inputting it to the proportional valve 66 during excavation work or ground leveling work to operate the direction selector valves 71 to 74 and thereby controlling respective operations of the boom cylinder 12, the arm cylinder 22, the bucket cylinder 32, and the bucket rotating motor 35. This function is achieved by at least one of a hardware configuration and a program (software configuration) installed in the controller 60.

Next will be described actions performed by the construction machine 1 according to the first embodiment during excavation work and ground leveling work. The construction machine 1 of the present embodiment is able to perform excavation work or ground leveling work by the bucket 30 while oscillating the bucket 30 based on the second rotational motion, namely, the yaw oscillation.

The excavation work is performed, for example, as follows. The operator of the construction machine 1 applies an operation for setting the cycle (or frequency) and the amplitude of the yaw oscillation of the bucket 30 to the bucket motion setting operation unit 54, and further an operation for setting the execution of the yaw oscillation (the operation for turning on the yaw oscillation).

Furthermore, the operator applies an appropriate travelling operation to a not-graphically-shown travelling operation lever to thereby move the construction machine 1 to a predetermined work place. Then, at the work place, the operator applies an appropriate work operation to a not-graphically-shown work operation lever for actuating the working device 4 to thereby actuate the boom 10 and the arm 20 to move the bucket 30 to the start position of the excavation work.

Next, the operator applies an ON operation to the automatic operation switch 55, and further applies a predetermined operation to a predetermined operation lever for starting the actual movement of the bucket 30 (for example, an arm operation lever for moving the arm 20). With this operation, the controller 60 determines a target movement path of the bucket 30 based on the current position of the construction machine 1 that is grasped from the GNSS signal input from the GNSS receiver 50, the inclination angle of the slewing body 3 that is grasped from the detection signal input from the inclination sensor 52, and work information stored in advance, that is, information on the actual topography of the work site and information on the target topography by excavation work (information on the position and orientation of the target construction surface St indicated by the two-dot chain line in FIG. 2), and further determine the trajectory of the target posture of the boom 10, the arm 20, and the bucket 30 (time-series pattern) respect to the pitch direction for realizing the target movement.

The target posture of the bucket 30 is determined, for example, so as to make a ground contact wall surface 30*f* (or the distal end portion of the claw portion 30*a*) follow the target construction surface St, as shown in FIG. 2, after the claw portion 30*a* of the bucket 30 bites into the ground, the ground contact wall surface 30*f* being a wall surface from the bottom portion 30*b* of the bucket 30 to the claw portion 30*a*.

Besides, the controller 60 determines a target waveform pattern of the yaw angle (the rotation angle around the yaw axis C1) θy (the pattern of temporal change in the target value of the yaw angle θy) so as to make the bucket 30 perform the yaw oscillation with the cycle and the amplitude set by the operation applied to the bucket motion setting operation unit 54. The target waveform pattern is set to, for example, a triangular wave pattern illustrated in FIG. 4. The target waveform pattern is not limited to the triangular wave pattern, but may be a smooth curved pattern such as a sine wave pattern.

Figure 4:
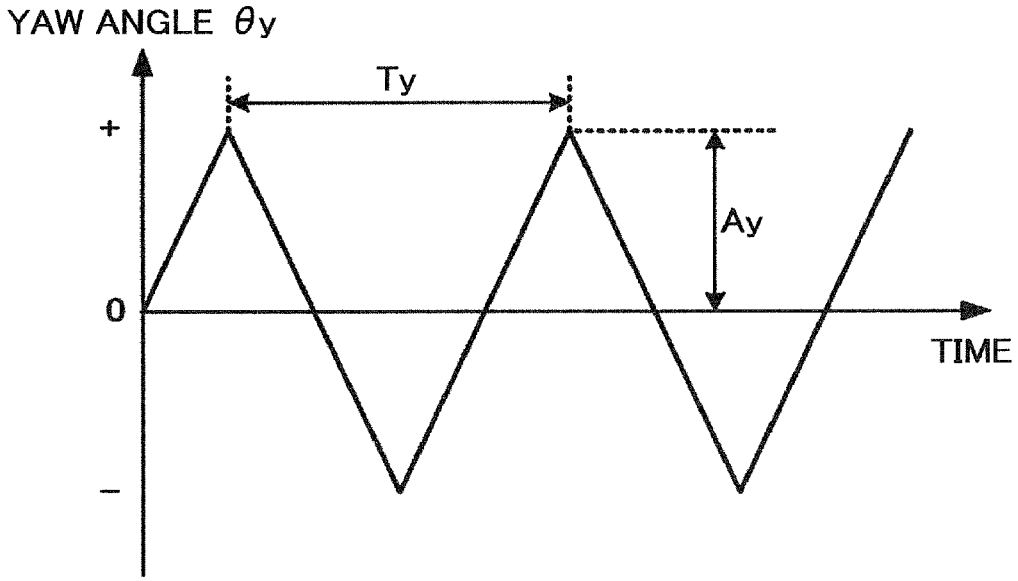
FIG. 4 is a graph showing temporal change in the yaw angle of the bucket according to the first embodiment.

The yaw angle θy of the bucket 30 shown in FIG. 4 is set so as to be zero in the state where the width direction of the bucket 30 (the direction in which the plurality of claw portions 30*a* are aligned in this embodiment) is coincident or substantially coincident with the direction of the bucket lateral axis (the axis of the support shaft 31 in this embodiment) that is the center axis of the first rotational motion, namely, the pitch motion, of the bucket 30 (that is, in the standard posture state of the bucket 30 with respect to the yaw direction).

The controller 60 inputs an appropriate command signal to the plurality of proportional valves 66 corresponding to the direction selector valves 71 to 73, respectively, to operate the pilot pressure to be applied to each of the direction selector valves 71 to 73 so as to make respective actual postures of the boom 10, the arm 20 and the bucket 30 with respect to the pitch direction follow the target posture, the actual postures being grasped from respective detection signals of the plurality of posture sensors 51. Thus, the control of respective operations of the boom cylinder 12, the arm cylinder 22, and the bucket cylinder 32 is performed to make the actual postures of the boom 10, the arm 20, and the bucket 30 in the pitch direction follow the target posture.

Figure 5:
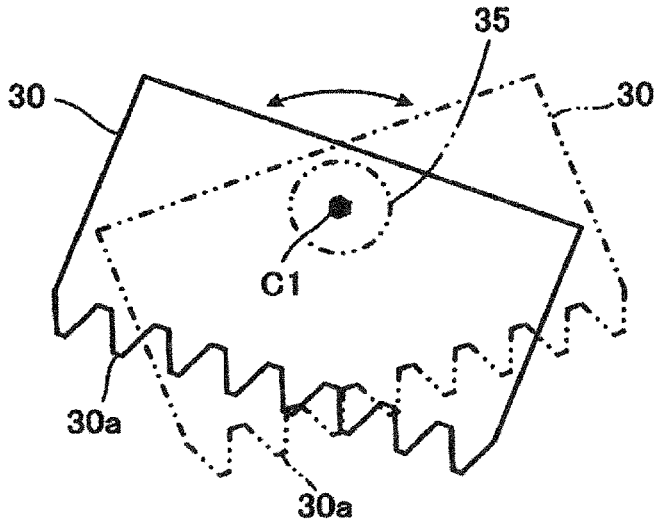
FIG. 5 is a bottom view showing a yaw oscillation of the bucket according to the first embodiment.

Besides, the controller 60 inputs an appropriate command signal to the proportional valve 66 corresponding to the direction selector valve 74 to control the pilot pressure to be applied to the direction selector valve 74 so that the yaw angle θy of the bucket 30 grasped from the detection signals of the plurality of posture sensors 51 changes according to a preset target waveform pattern. This causes the actual yaw angle θy of the bucket 30 to change so as to follow the target waveform pattern. Thus, as shown in FIG. 5, the yaw oscillation of the bucket 30 is achieved such that the actual yaw angle of the bucket 30 changes alternately in the forward rotational direction and the reverse rotational direction at a constant amplitude and cycle.

Such control of the operation of the working device 4 allows a ground excavation work to be performed in which the bucket 30 is moved along the target movement path with the yaw oscillation of the bucket 30.

The bucket rotating motor 35 for causing the yaw oscillation of the bucket 30 in the yaw oscillation is allowed to be relatively small. This makes it possible to make the bucket 30 perform the yaw oscillation at a relatively short cycle. This allows the number of repetitions of the yaw motion per unit movement amount of the bucket 30 during excavation work to be increased, thereby effectively reducing the resistance which the bucket 30 receives during its movement with pressure contact with the ground, specifically, with the plurality of claw portions 30*a* biting into the ground.

Furthermore, it is possible to form a smooth construction surface by moving the bucket 30 along the target construction surface St with the yaw oscillation thereof while constantly keeping at least one of the ground contact wall surface 30*f* and the distal ends of the plurality of claw portions 30*a* of the bucket 30 following the target construction surface St.

The ground leveling work is performed, for example, as follows. Similarly to the case of the excavation work, the operator of the construction machine 1 applies to the bucket motion setting operation unit 54 an operation of setting the cycle Ty (or frequency) and the amplitude Ay of the yaw oscillation of the bucket 30 and further an operation of turning on the yaw oscillation. Moreover, the operator applies an appropriate travelling operation to the travelling operation lever to move the construction machine 1 to a predetermined work place, and, at the work place, applies an appropriate operation lever to an operation lever for operating the working device 4 to thereby actuate the boom 10 and the arm 20 as the working device body to move the bucket 30 to the start position for the ground leveling work.

Next, the operator applies an ON operation to the automatic operation switch 55 and further applies a predetermined operation to a predetermined operation lever (for example, the arm operation lever) for starting the actual movement of the bucket 30. In accordance with this operation, the controller 60 determines the target movement path of the bucket 30 and further determines a trajectory (time-series pattern) of the target posture of each of the boom 10, the arm 20, and the bucket 30 with respect to the pitch direction for realizing the target movement path, as in the case of the excavation work.

Figure 6:
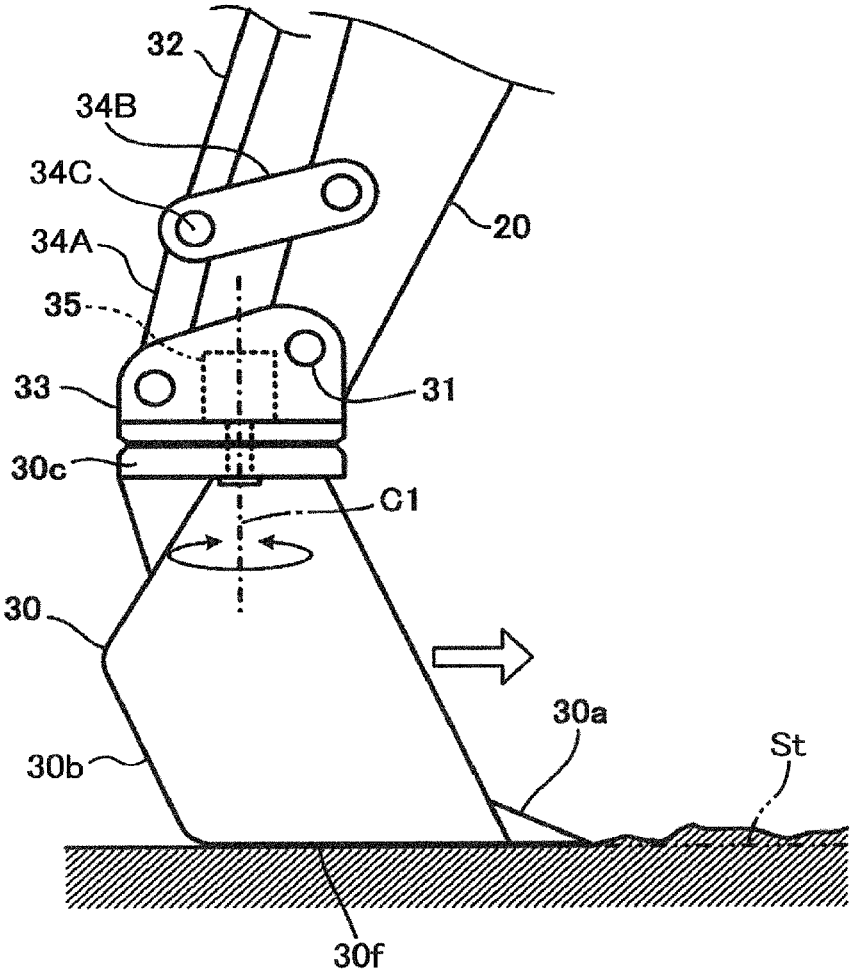
FIG. 6 is a side view showing the main part including the bucket according to the first embodiment.

As shown in FIG. 6, the target movement path and the target posture of the bucket 30 are determined so as to make the ground contact wall surface 30*f*, which is the wall surface of the bucket 30 from the bottom portion 30*b* to the plurality of claw portions 30*a*, follow the target construction surface (target ground surface) St.

Besides, as in the case of excavation work, the controller 60 determines the target waveform pattern of the angle θy of the bucket 30 so as to make the bucket 30 perform the yaw oscillation at the cycle and the amplitude set by the operation applied to the bucket motion setting operation unit 54.

As in the case of excavation work, the controller 60 inputs appropriate command signals to the proportional valves 66 corresponding to the direction selector valves 71 to 73, respectively, to control respective operations of the boom cylinder 12, the arm cylinder 22 and the bucket cylinder 32 so as to make respective actual postures of the boom 10, the arm 20, and the bucket 30 with respect to the pitch direction follow the target posture.

Besides, as in the case of excavation work, the controller 60 inputs appropriate command signals to the proportional valve 66 corresponding to the direction selector valve 74 to control the operation of the bucket rotating motor 35 so as to change the actual yaw angle θy of the bucket 30 according to the target waveform pattern, thereby making the bucket 30 perform the yaw oscillation corresponding to the target waveform pattern.

Conducting such control of the operation of the working device 4 enables the ground leveling work of moving the bucket 30 along the target movement path with the yaw oscillation of the bucket 30 to be achieved.

Also in the ground leveling work, as in the excavation work, the bucket 30 can be yaw-oscillated at a relatively short cycle, which effectively reduces the resistance which the bucket 30 receives when the bucket 30 is moved along the target movement path with pressure contact with the ground, specifically, while the ground contact wall surface 30*f* is pressed against the ground.

In addition, a smooth construction surface can be formed by moving the bucket 30 along the target movement path with the yaw oscillation of the bucket 30 while constantly keeping at least one of the ground contact wall surface 30*f* and the distal end portions of the plurality of claw portions 30*a* of the bucket 30 following the target construction surface St.

Next will be below described a second embodiment of the present invention with reference to FIGS. 7 to 10. Among the components included in the second embodiment, the same components as those included in the first embodiment will not be described.

Figure 7:
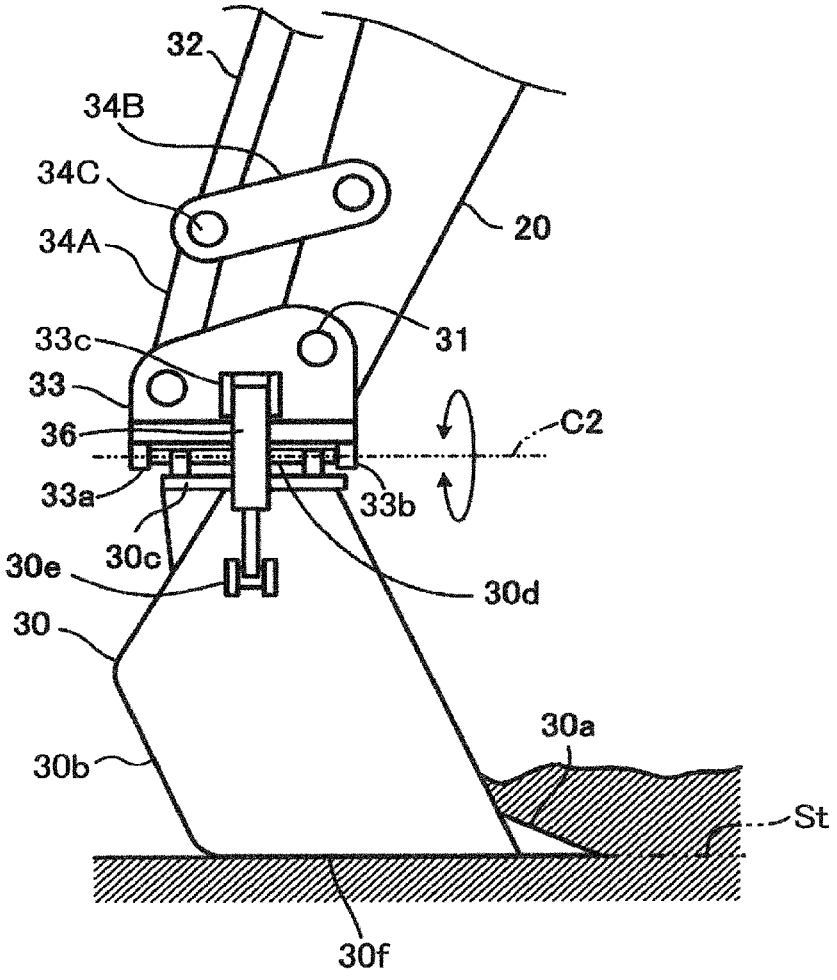
FIG. 7 is a side view showing a main part including a bucket of a construction machine according to the second embodiment of this invention.
Figure 10:
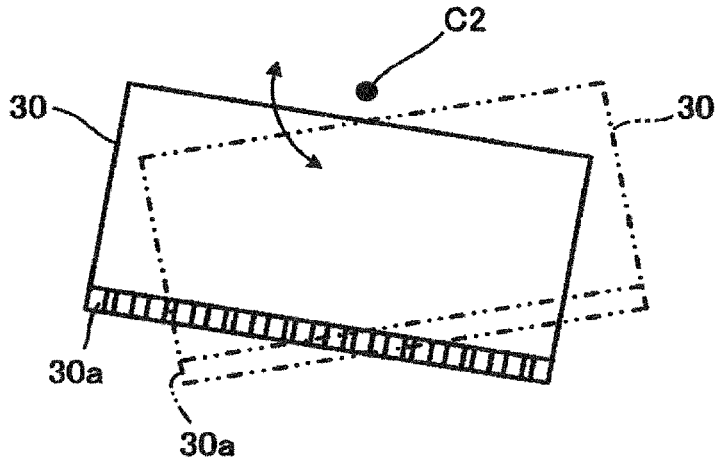
FIG. 10 is a rear view showing the tilt oscillation of the bucket according to the second embodiment.

As shown in FIG. 7, the bucket 30 according to the second embodiment includes a plurality of claw portions 30*a* and a bucket-side attachment member 30*c*, as well as the bucket 30 according to the first embodiment, and is attached to the distal end of an arm 20 so as to be able to perform a pitch motion and a tilt motion relatively to the arm 20. The tilt motion is a rotational motion around a tilt axis C2 extending in a direction parallel to (including almost coincident with) the extending direction of the plurality of claw portions 30*a* in the bucket 30, that is, the projecting direction of the plurality of claw portions 30*a*. The tilt axis C2 is preferably located immediately above the bucket 30 when viewed along the direction of the tilt axis C2 as shown in FIG. 10.

In other words, the tilt axis C2 according to the second embodiment is an axis parallel (including substantially parallel) to the ground contact wall surface 30*f* and orthogonal (including a substantially orthogonal) to the bucket lateral axis. The "tilt motion" according to the second embodiment, therefore, corresponds to a rotational motion around an axis in a direction orthogonal to the bucket lateral axis, namely, a second rotating operation according to the present invention.

Specifically, the bucket-side attachment member 30*c* includes a flat plate-shaped main body, to which a rotary shaft 30*d* is fixed. The rotary shaft 30*d* is fixed to the bucket-side attachment member 30*c* in a posture of extending in a direction parallel to the main body of the bucket-side attachment member 30*c*, and the axis of the rotary shaft 30*d* is aligned with the tilt axis C2. On the other hand, similarly to the first embodiment, the arm-side attachment member 33 is attached to the arm 20 so as to be capable of performing the pitch motion, that is, a rotational motion around the axis in the left-right direction of the slewing body 3, supporting the opposite ends of the rotary shaft 30*d* rotationally movably around the tilt axis C2 through bearings 33*a* and 33*b*, respectively.

The construction machine 1 according to the second embodiment includes, as a tilt actuator for making the bucket 30 perform the tilt motion, that is, a second bucket actuator for making the bucket 30 perform a second rotating operation, a pair of right and left bucket tilt cylinders 36 each being a hydraulic cylinder. The pair of right and left bucket tilt cylinders 36 are provided between the right and left side surfaces of the bucket 30 and the arm-side attachment member 33. In the example shown in FIG. 7, each of the pair of bucket tilt cylinders 36 includes a rod-side end portion (lower end portion in the posture shown in FIG. 7) connected to the right and left side surfaces of the bucket 30 and a head-side end portion (upper end portion in the posture shown in FIG. 7) connected to the arm-side attachment member 33. FIG. 7 shows only the left bucket tilt cylinder 36. The head-side end portion is an end portion opposite to the rod of the cylinder body of the bucket tilt cylinder 36, and connected to the bracket 33*e* fixed to the arm-side attachment member 33 so as to be swingable about an axis in a direction parallel to the tilt axis C2. The rod-side end portion is a distal end portion of the rod, being connected to brackets 30*e* fixed to the right and left side surfaces of the bucket 30 so as to be swingable about an axis in a direction parallel to the tilt axis C2.

The bucket 30 according to the second embodiment, therefore, performs the first rotational motion around the axis of the support shaft 31, namely, the pitch motion, in response to the expansion and contraction motions of the bucket cylinder 32, similarly to the first embodiment, and the second tilting motion about the tilt axis C2 in response to the expansion/contraction motion of the bucket tilt cylinder 36, specifically, the expansion motion of one of the bucket tilt cylinders 36 and the contraction motion of the other of the bucket tilt cylinders 36.

The tilt actuator that rotationally moves the bucket 30 in the tilt direction (the second bucket actuator according to the invention) is not limited to the pair of bucket tilt cylinders 36. The tilt actuator may be, for example, a hydraulic motor or an electric motor that is connected to the rotary shaft 30*d* and rotates the rotary shaft 30*d* to thereby move the bucket 30 rotationally about the tilt axis C2.

Figure 8:
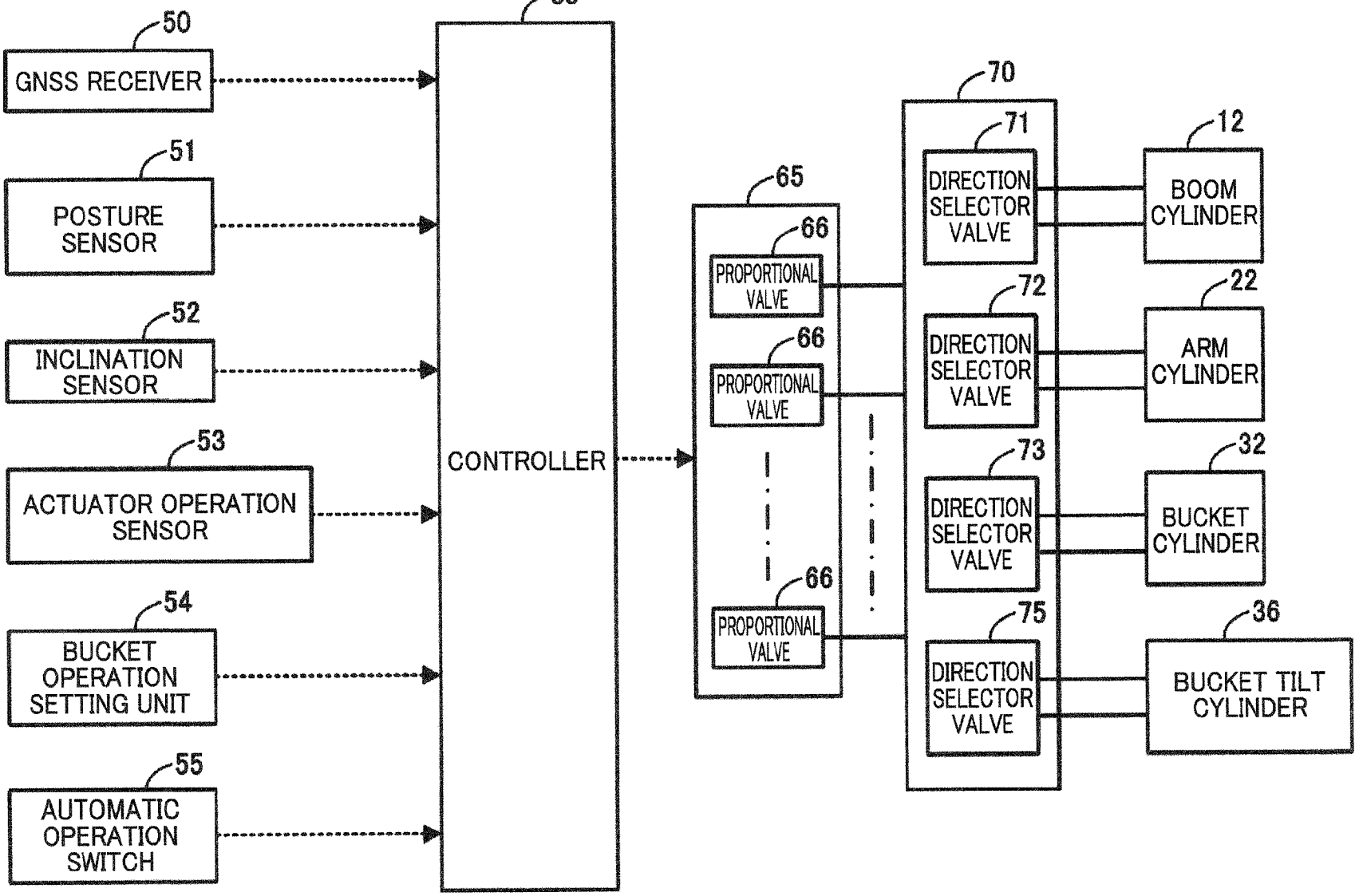
FIG. 8 is a block diagram showing a functional configuration of a control device of the construction machine according to the second embodiment.

Similarly to the first embodiment, the construction machine 1 according to the second embodiment includes a controller 60, a proportional valve group 65, and a control valve unit 70 as shown in FIG. 8, but the control valve unit 70 includes a pilot operated direction selector valves 75 connected to the pair of bucket tilt cylinders 36, respectively, in place of the direction selector valve 74 connected to the bucket rotating motor 35 in the first embodiment, and the proportional valve group 65 includes a proportional valve 66 connected to a pair of pilot ports of the direction selector valve 75 in place of the proportional valve 66 connected to the pair of pilot ports of the direction selector valve 74 in the first embodiment.

Besides, while the construction machine 1 according to the second embodiment includes a plurality of posture sensors 51 similarly to the first embodiment, the plurality of posture sensors 51 includes an angle sensor that detects the tilt angle θt that is the rotation angle of the bucket 30 in the tilt direction, that is, the rotation angle around the tilt axis C2, in place of the angle sensor that detects the yaw angle θy of the bucket 30 in the first embodiment.

While the construction machine 1 according to the second embodiment includes the bucket motion setting operation unit 54 similarly to the first embodiment, the bucket motion setting operation unit 54 is configured to allow an operation to be applied to the bucket motion setting operation unit 54 during the excavation work by the construction machine 1, the operation being an operation for setting necessity of tilt oscillation, which is the oscillation in the tilt direction of the bucket 30 (a cyclically rotational motion by a predetermined angle alternately in the forward rotation direction and the reverse rotation direction around the tilt axis C2, that is, an oscillation based on the second rotational motion), the cycle Tt (or frequency) of a tilt oscillation, and the tilt oscillation amplitude At (maximum rotation angle in the forward rotation direction and the reverse rotation direction). The cycle Tt (or frequency) and the amplitude At of the tilt oscillation can be set within respective predetermined ranges.

Next will be described an action performed by the construction machine 1 according to the second embodiment during excavation work. The construction machine 1 is capable of performing excavation work by the bucket 30 while oscillating the bucket 30 based on the second rotational motion thereof, namely, the tilt oscillation.

The excavation work is performed, for example, as follows. The operator of the construction machine 1 applies an operation for setting the cycle (or frequency) and amplitude of the tilt oscillation of the bucket 30 to the bucket motion setting operation unit 54, and further applies an operation for setting the execution of the tilt oscillation (tilt oscillation ON operation).

Furthermore, the operator applies an appropriate travelling operation to a not-graphically-shown travelling operation lever to thereby move the construction machine 1 to a predetermined work place. Then, at the work place, the operator applies an appropriate work operation to a not-graphically-shown work operation lever for moving the working device 4 to thereby actuate the boom 10 and the arm 20 to move the bucket 30 to the start position of the excavation work.

Next, the operator applies an ON operation to the automatic operation switch 55, and further applies a predetermined operation to a predetermined operation lever (for example, the arm operation lever) for starting the actual movement of the bucket 30. In accordance with this operation, the controller 60 determines a target movement path of the bucket 30, similarly to the controller 60 according to the first embodiment, and further determines the trajectory of respective target postures (time-series patterns) of the boom 10, the arm 20, and the bucket 30 with respect to the pitch direction to achieve the arm 20 for realizing the target movement path.

The target movement path and the target posture of the bucket 30 are determined, for example, so that the lowermost one of the plurality of claw portions 30*a* of the bucket 30 follows the target construction surface St indicated by the chain double-dashed line shown in FIG. 7 when the bucket 30 performs the tilt motion by the maximum angle in each of the forward rotation direction and the reverse rotation direction as shown in FIG. 10 with the amplitude set by the bucket motion setting operation unit 54 (that is, when performing a rotational motion around the tilt axis C2) after the claw portion 30*a* of the bucket 30 bites into the ground.

Besides, the controller 60 determines a target waveform pattern of the tilt angle (rotation angle around the tilt axis C2) θt of the bucket 30 (a pattern of temporal change in the target value of the tilt angle θt) so as to make the bucket 30 perform the tilt oscillation at the cycle and the amplitude set by an operation applied to the bucket motion setting operation unit 54. The target waveform pattern is set to, for example, a triangular wave pattern illustrated in FIG. 9. The target waveform pattern is not limited to the triangular wave pattern, but may be a smooth curved pattern such as a sine wave pattern.

Figure 9:
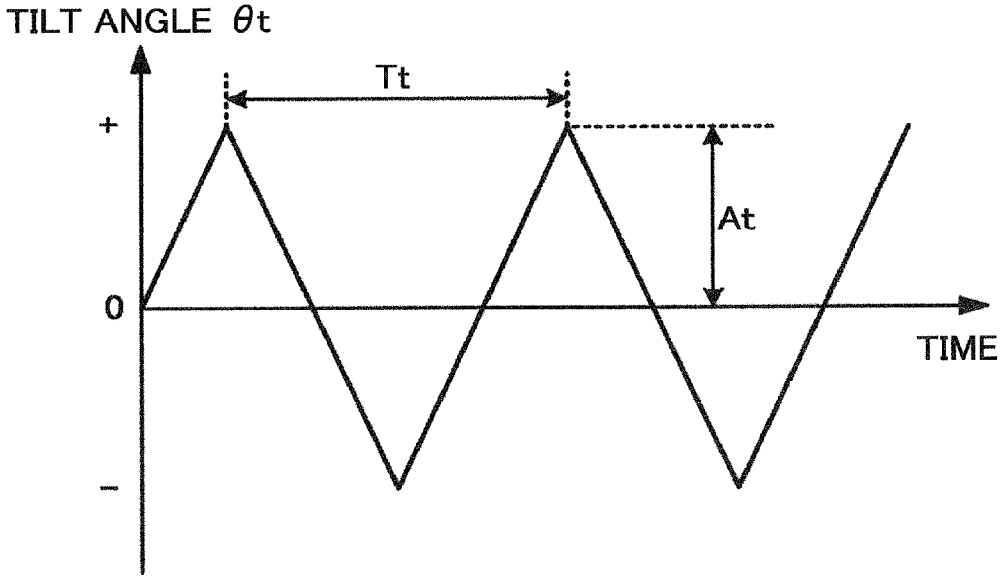
FIG. 9 is a graph showing temporal change in the tilt angle of the bucket according to the second embodiment.

The tilt angle θt of the bucket 30 shown in FIG. 9 is set so as to be zero in a state where the width direction of the bucket 30 (the direction in which the plurality of claw portions 30*a* are aligned) coincides or substantially coincides with the direction of the bucket lateral axis (the axis of the support shaft 31 in this embodiment) that is the axis of the first rotational motion of the bucket 30, namely, the pitch motion (that is, the standard posture state of the bucket 30 with respect to the tilt direction).

Similarly to the controller 60 according to the first embodiment, the controller 60 inputs appropriate command signals to the plurality of proportional valves 66 corresponding to the direction selector valves 71 to 73, respectively, to thereby control respective operations of the boom cylinder 12, the arm cylinder 22 and the bucket cylinder 32 so as to make the actual postures of the boom 10, the arm 20, and the bucket 30 with respect to the pitch direction follow the target posture.

Besides, the controller 60 inputs an appropriate command signal to the proportional valve 66 corresponding to the direction selector valve 75 to operate the pilot pressure applied to the direction selector valve 75 so as to cause the actual tilt angle θt of the bucket 30 grasped from respective detection signals of the plurality of posture sensors 51 to change according to a preset target waveform pattern. The actual tilt angle θt of the bucket 30 thereby changes so as to follow the target waveform pattern. Specifically, as shown in FIG. 10, the bucket 30 performs such a second rotational motion (tilt motion) that the actual tilt angle θt of the bucket 30, that is, the rotation angle around the tilt axis C2, changes alternately in the forward rotation direction and the reverse rotation direction with a constant amplitude At and cycle Tt.

Conducting such operation control of the working device 4 during excavation work enables excavation work to the ground to be performed so as to move the bucket 30 along the target movement path with the tilt oscillation thereof.

The pair of bucket tilt cylinders 36 for tilt-oscillating the bucket 30 are allowed to be relatively small. This makes it possible to make the bucket 30 perform the tilt oscillation at a relatively short cycle, thus allowing the number of times the tilt motion is repeated per unit movement amount of the bucket 30 during excavation work to be increased. This effectively reduces the resistance that the bucket 30 receives during its movement with the claw portion 30*a* biting into the ground.

Besides, the tilt oscillation of the bucket 30, that is, the oscillation based on the rotational motion around the tilt axis C2 in the direction parallel to the extending direction of the plurality of claw portions 30*a*, involving no fluctuation of respective orientations of the plurality of claw portions 30*a* of the bucket 30, allows the orientations of the plurality of claw portions 30*a* to be constantly kept in the direction parallel to the moving direction of the bucket 30 regardless of the tilt oscillation. This enables the smoothness of the construction surface achieved by the excavation work to be ensured.

Furthermore, as described above, setting the bucket 30 so as to make the lowest claw portion 30*a* of the plurality of claw portions 30*a* follow the target construction surface when the bucket 30 is rotationally moved by the maximum angle in each of the forward rotation direction and the reverse rotation direction in the tilt oscillation enables the construction surface achieved by the excavation work to be prevented from being deeper than the target construction surface St.

The present invention is not limited to the embodiments described above. The present invention, for example, includes the following aspects.

While the yaw oscillation and the tilt oscillation of the bucket 30 in the first and second embodiments are performed during the excavation work and the ground preparation work by automatic control, the aspects of the excavation work and the ground preparation work according to the present invention are not limited. For example, the yaw oscillation or the tilt oscillation of the bucket 30 may be performed when an operator applies a manual operation to a predetermined operation button or the like for an excavation work or a leveling work.

While the bucket 30 in the first embodiment and the second embodiment is rotationally movable only in one of the yaw direction and the tilt direction, the present invention is not limited to this. The bucket according to the present invention may be attached to the distal end of the working device body (for example, the distal end of the arm 20) so as to be rotationally movable in both the yaw direction and the tilt direction.

While both of the amplitude and the cycle of the yaw oscillation and the tilt oscillation of the bucket 30 in the first embodiment and the second embodiment are variable and can be set by the operator or the like, the present invention is not limited to this. For example, only one of the amplitude and the cycle may be variable, or both the amplitude and the cycle may be fixed to constant values.

The construction machine according to the present invention is not limited to the crawler type hydraulic excavator as shown in FIG. 1. The construction machine according to the present invention may be, for example, a wheel type excavator. Besides, the construction machine according to the present invention may include no slewing body slewable relatively to the travelling body. Besides, the working device body (for example, the boom 10) may be capable of performing, in addition to the pitch motion, a yaw motion that is a rotational motion about a vertical axis and/or a sliding motion parallel to the width direction of the slewing body 3.

As described above, performed is a construction machine capable of reducing the resistance that a bucket receives from the ground and improving the smoothness of the construction surface. Provided is a construction machine comprising a machine body, a working device mounted on the machine body, and a control device for controlling a motion of the working device. The working device includes a working device body having a proximal end portion connected to the machine body and a distal end opposite thereto, a bucket attached to the distal end of the working device body so as to be capable of performing a first rotational motion and a second rotational motion relative to the distal end of the working device body, and a plurality of bucket actuators that actuate the bucket relatively to the working device body. The first rotational motion is a pitch motion that is a rotational motion about a bucket lateral axis parallel to a width direction of the bucket. The second rotational motion is a rotational motion about an axis in a direction orthogonal to the bucket lateral axis. The plurality of bucket actuators include a first bucket actuator that makes the bucket perform the first rotational motion and a second bucket actuator that makes the bucket perform the second rotational motion. The control device is configured to control the second bucket actuator so as to make the second bucket actuator periodically oscillate the bucket based on the second rotational motion in a state where the bucket is in pressure contact with the ground.

In the construction machine, the second bucket actuator for making the bucket perform the second rotational motion (for example, a yaw motion or a tilt motion) is allowed to be smaller than the first actuator that makes the bucket perform the first rotational motion that is the pitch motion. This makes it possible to make the bucket perform the second rotational motion (for example, the yaw motion or the tilt motion) quickly at a relatively short cycle. Hence, periodically oscillating the bucket based on the second rotational motion during work with pressure contact of the bucket with the ground (for example, during excavation work or ground leveling work) effectively reduces the resistance that the bucket receives from the ground.

In the case where the bucket includes a bottom portion, a plurality of claw portions projecting in the direction at the distal end of the bucket, and a ground contact wall surface that is a wall surface from the bottom portion to the plurality of claw portions and contactable with a construction surface, it is preferable that the second rotational motion is, for example, a yaw motion that is a rotational motion around an axis in a direction orthogonal to the ground contact wall surface. Hence, it is preferable that the control device is configured to control the second bucket actuator so as to make the second bucket actuator oscillate the bucket in a yaw direction that is the direction of the yaw motion. With the yaw motion, the bucket can be oscillated while keeping the ground contact wall surface, that is, the wall surface from the bottom portion of the bucket to the plurality of claw portions, in a substantially constant posture. This makes it possible to move the bucket with restraint of undulations from occurring in the construction surface to thereby form a smooth construction surface with reduced resistance that the bucket receives from the ground during its movement.

In such mode that the bucket is able to perform the yaw motion, it is preferable that the control device is configured to control an operation of the working device to move the bucket so as to make at least one of the ground contact wall surface and the distal end portions of the plurality of claw portions follow a target construction surface during excavation work for excavating the ground with the bucket. This allows the construction surface achieved by the excavation work to be accurately coincided with the target construction surface.

Besides, the control device is preferably configured to control an operation of the second bucket actuator so as to make the second bucket actuator periodically oscillate the bucket in a yaw direction that is a direction of the yaw motion during ground leveling work for leveling the ground by moving the bucket while pressing the ground contact wall surface against the ground. The yaw motion of the bucket, allowing the ground contact wall surface of the bucket to be kept in a substantially constant posture, enables the ground to be smooth leveled.

It is preferable that the control device is configured to control the operation of the working device to move the bucket so as to make the ground contact wall surface of the bucket follow a target construction surface during the ground leveling work. This control allows the construction surface achieved by the leveling work to be accurately coincided with the target construction surface.

In the case where the bucket includes a bottom portion, a plurality of claw portions projecting in the same direction at the distal end of the bucket, and a ground contact wall surface that is a wall surface from the bottom portion to the plurality of claw portions and contactable with a construction surface, the second rotational motion may be a tilt motion that is a rotational motion around an axis in a direction in which the plurality of claw portions project. In short, the control device may be configured to control the second bucket actuator so as to make the second bucket actuator oscillate the bucket in the direction of the tilt motion. The tilt motion allows the projecting direction of the plurality of claw portions to be kept in the same direction as the moving direction of the bucket (excavation direction) during excavation work. This allows the bucket to be moved with restraint of undulations from occurring in the construction surface, thereby making it possible to form a smooth construction surface with reduced resistance that the bucket receives from the ground during its movement.

In the mode where the bucket is able to perform the tilt motion as described above, the control device is preferably configured to control the operation of the working device to move the bucket so as to make the lowermost claw portion of the plurality of claw portions of the bucket follow a target construction surface when the bucket is rotationally moved in a direction of the tilt motion by the maximum rotational motion amount in the oscillation of the bucket in the direction of the tilt motion during excavation work for excavating the ground with the bucket. This control prevents the tilt motion from rendering the construction surface achieved by the excavation work deeper than the target construction surface.

It is preferable that the control device is configured to make at least one of a cycle and an amplitude of oscillation of the bucket be changeable. This allows at least one of the cycle and the amplitude of the bucket oscillation to be set to a value suitable, for example, for the state of the ground as a work target.

The invention claimed is:

1. A construction machine comprising:

a machine body;

a working device mounted on the machine body; and a control device that controls a motion of the working device, wherein:

the working device includes a working device body having a proximal end portion connected to the machine body and a distal end opposite thereto, a bucket attached to the distal end of the working device body so as to be capable of performing a first rotational motion and a second rotational motion relative to the distal end of the working device body, and a plurality of bucket actuators that actuate the bucket relatively to the working device body;

the first rotational motion is a pitch motion that is a rotational motion about a bucket lateral axis parallel to a width direction of the bucket, and the second rotational motion is a rotational motion about an axis in a direction orthogonal to the bucket lateral axis;

the plurality of bucket actuators include a first bucket actuator that makes the bucket perform the first rotational motion and a second bucket actuator that makes the bucket perform the second rotational motion; and the control device is configured to control the second bucket actuator so as to make the second bucket actuator periodically oscillate the bucket according to the second rotational motion in a state where the bucket is in pressure contact with the ground and with at least one of a preset cycle and amplitude.

2. The construction machine according to claim 1, wherein: the bucket includes a bottom portion, a plurality of claw portions projecting in the same direction at the distal end of the bucket, and a ground contact wall surface that is a wall surface from the bottom portion to the plurality of claw portions and contactable with a construction surface; the second rotational motion is a yaw motion that is a rotational motion around an axis in a direction orthogonal to the ground contact wall surface; and the control device is configured to control the second bucket actuator so as to make the second bucket actuator oscillate the bucket in a yaw direction that is a direction of the yaw motion.

3. The construction machine according to claim 2, wherein the control device is configured to control an operation of the working device to move the bucket so as to make at least one of the ground contact wall surface and the distal end portions of the plurality of claw portions follow a target construction surface during excavation work for excavating the ground with the bucket.

4. The construction machine according to claim 2, wherein the control device is configured to control the second bucket actuator so as to make the second bucket actuator periodically oscillate the bucket in a yaw direction that is a direction of the yaw motion during ground leveling work for leveling the ground by moving the bucket while pressing the ground contact wall surface against the ground.

5. The construction machine according to claim 4, wherein the control device is configured to control the operation of the working device to move the bucket so as to make the ground contact wall surface of the bucket follow a target construction surface during the ground leveling work.

6. The construction machine according to claim 1, wherein: the bucket includes a bottom portion, a plurality of claw portions projecting in the same direction at the distal end of the bucket, and a ground contact wall surface that is a wall surface from the bottom portion to the plurality of claw portions and contactable with a construction surface; the second rotational motion is a tilt motion that is a rotational motion around an axis in a direction in which the plurality of claw portions project; and the control device is configured to control the second bucket actuator so as to make the second bucket actuator oscillate the bucket in a direction of the tilt motion.

7. The construction machine according to claim 6, wherein the control device is configured to control an operation of the working device to move the bucket so as to make the lowermost claw portion of the plurality of claw portions of the bucket follow a target construction surface when the bucket is rotationally moved in a direction of the tilt motion by the maximum rotational motion amount in the oscillation of the bucket in the direction of the tilt motion during excavation work for excavating the ground with the bucket.

8. The construction machine according to claim 1, wherein the control device is configured to make at least one of the cycle and the amplitude of oscillation of the bucket be changeable.

* * * * *